US006220162B1

(12) United States Patent
Kolbe et al.

(10) Patent No.: US 6,220,162 B1
(45) Date of Patent: Apr. 24, 2001

(54) METHOD AND APPARATUS FOR DETECTING COLLISIONS IN PRINTING MACHINES

(75) Inventors: Wilfried Kolbe, Gülzow; Klaus Schirrich, Bielefeld; Manfred Terstegen, Bielefeld; Bodo Steinmeier, Bielefeld, all of (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 09/376,257

(22) Filed: Aug. 18, 1999

(30) Foreign Application Priority Data

Aug. 29, 1998 (DE) ..... 98 116 398

(51) Int. Cl.[7] ..... B41F 1/50

(52) U.S. Cl. ..... 101/484; 101/483; 101/485; 101/351.1; 101/352.01

(58) Field of Search ..... 101/484, 483, 101/485, 351.1, 351.2, 351.3, 351.4, 352.01, 352.02, 352.03, 352.04, 352.05, 247

(56) References Cited

U.S. PATENT DOCUMENTS

| | | | | |
|---|---|---|---|---|
| 5,125,339 | * | 6/1992 | Rogge | 101/247 |
| 5,142,981 | * | 9/1992 | Dettinger et al. | 101/247 |
| 5,181,468 | * | 1/1993 | Borel | 101/247 |
| 5,588,362 | * | 12/1996 | Sugiyama et al. | 101/247 |
| 5,953,991 | * | 9/1999 | Geissenberger et al. | 101/247 |

FOREIGN PATENT DOCUMENTS 0226554 6/1987 (EP) .

* cited by examiner

*Primary Examiner*—Daniel J. Colilla
(74) *Attorney, Agent, or Firm*—Richard M. Goldberg

(57) ABSTRACT

Apparatus for detecting collisions in a printing machine having at least one rotationally driveable rotary body (18; 20) and an actuator (28; 30) for adjusting the rotary body in a direction normal to the axis of rotation, the apparatus including a torque sensor (T) and/or an angle increment sensor (Ω) for detecting the driving torque and/or the rotary speed of the rotary body (18; 20), and a control unit (38) adapted to detect a collision of the rotary body with another component member on the basis of the signal of the torque or angle increment sensor and to stop the actuator (28; 30) thereupon.

7 Claims, 1 Drawing Sheet

METHOD AND APPARATUS FOR DETECTING COLLISIONS IN PRINTING MACHINES

BACKGROUND OF THE INVENTION

The invention relates to a method and an apparatus for detecting collisions in printing machines.

Printing machines typically have a number of rotationally driveable rotary bodies, each of which can be adjusted in a direction normal to the axis of rotation by means of an associated actuator. For example, in a typical flexographic printing machine, a plurality of inking units are arranged at a common reaction cylinder, and each inking unit has two such rotary bodies, i.e. a printing cylinder and an inking roller. During the printing operation the inking roller is in rolling engagement with the printing cylinder, and the printing cylinder itself is in rolling engagement with the printing medium which is guided around the reaction cylinder, so that the ink is transferred from the inking roller to the printing parts of the printing blocks of the printing cylinder and, then, a corresponding printed image is formed. In case of maintenance and retooling, for example, when the cylinders are exchanged, the inking roller is separated from the printing cylinder, and the printing cylinder is separated from the reaction cylinder. To this end, the inking roller and the printing cylinder are moved (adjusted) in a substantially radial direction relative to the reaction cylinder by means of their respective actuators. In this case there is a risk that the inking roller and the printing cylinder collide with one another or with other machine components, so that damages are caused.

It is therefore common practice to provide a monitoring system for detecting such collisions and for stopping the corresponding actuators immediately, in order to avoid damages or injuries of the operating personnel.

In conventional printing machines the detection of collisions is achieved by monitoring the driving torques of the actuator motors. When the rotary body hits an obstacle during the adjustment process, the driving torque transmitted from the actuator motor is increased, and when this driving torque exceeds a certain threshold value, this indicates that a collision has occurred, and the actuator motor is stopped.

The actuator, e.g. a spindle drive, generally has a large transmission ratio, so that even a comparatively small torque of the drive motor generates a high actuating force. Conversely, this means that the increase of the resistance opposing the adjusting movement in case of a collision leads to only a comparatively small increase in the transmitted torque. The collision detection system is therefore relatively slow and inaccurate. Although, in principle, the sensitivity can be increased by lowering the threshold value at which the actuator motor is stopped, this threshold value must always be selected so high that the sometimes considerably high frictional forces which occur during the adjusting movement can be overcome.

SUMMARY OF THE INVENTION

It is therefore an object of the invention to increase the sensitivity in the detection of collisions.

In a method according to the present invention, this object is achieved by the feature that the rotary body is caused to rotate during the adjusting movement, and the rotary speed and/or the driving torque for the rotary movement is monitored.

When the rotary body collides with an obstacle during an adjustment operation, this blocks not only the further adjusting movement, but it also brakes the rotary movement. By monitoring the rotary speed and/or the torque of the rotary drive for the rotary body, this braking of the rotation can be detected with high sensitivity, so that, in case of a collision, a quicker and more sensitive response of the collision detection system is achieved. Another advantage of this solution is that the response sensitivity does not depend on the location at the circumference of the roller where the collision with the obstacle takes place. When, for example, the rotating body hits the obstacle in a glancing manner during the displacement, the displacement itself is scarcely blocked, but nevertheless the rotation is braked significantly, so that, even in this case, a more sensitive response of the collision detection system is assured. In particular, it is possible in this way to detect situations in which the rotary body is directly touched by an operator. Thus, injuries can be avoided reliably by immediately stopping the actuator and possibly also the rotary drive.

The solution according to the invention is particularly advantageous in printing machines of the single-drive type in which a separate drive motor is provided for the rotary drive of each rotary body. In this case, each rotary drive is provided with an angle increment sensor or torque sensor, anyway, for synchronising the rotary bodies, and this sensor and then be utilised as well for the collision detection, so that the construction of the collision detection system can be simplified.

BRIEF DESCRIPTION OF THE DRAWINGS

Embodiments of the invention will now be explained in conjunction with the accompanying drawings in which.

DETAILED DESCRIPTION

Figure 1:
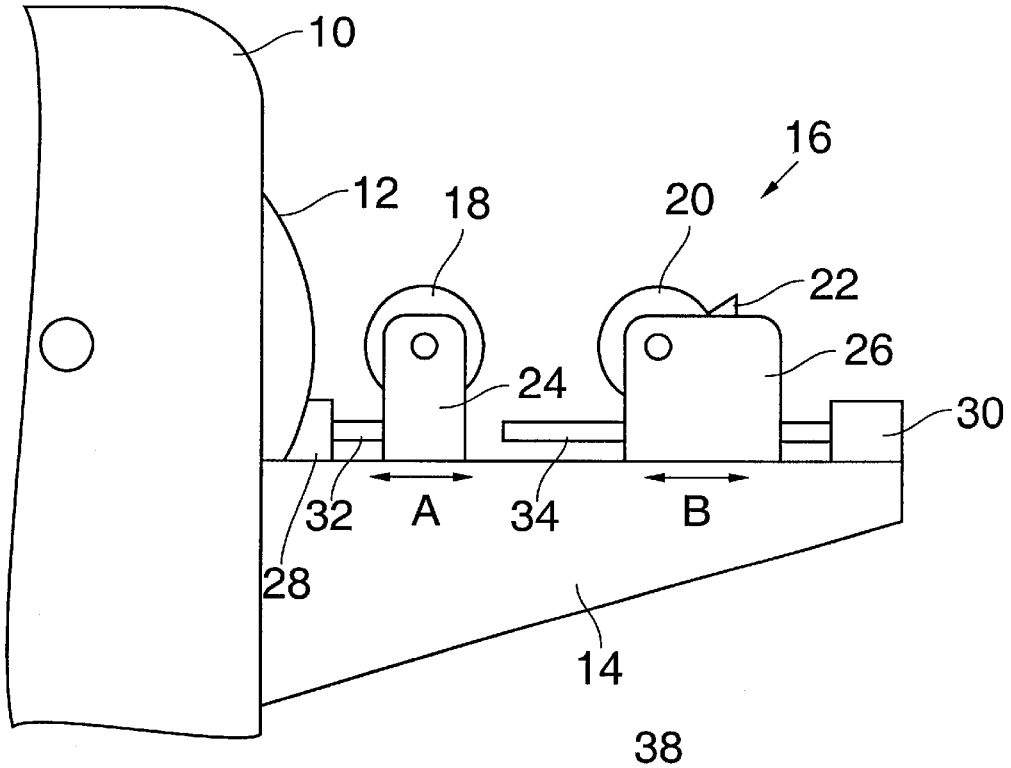
FIG. 1 is a schematic side elevational view of a part of a printing machine to which the invention is applied.

The printing machine shown in FIG. 1, for example, a flexographic printing machine, has a frame with two side members 10 and a reaction cylinder 12 rotatably supported therebetween. Attached to each side member 10 is a console 14 on which an inking unit 16 is mounted. In practice, a plurality of inking units can be arranged at one and the same reaction cylinder 12.

The inking unit 16 comprises a printing cylinder 18 and an inking roller 20 with an associated chamber-type ink fountain 22. The printing cylinder 18 and the inking roller 20 are rotatably supported in bearing blocks 24 and 26 which are arranged to be adjustable in the direction of double-arrows A and B on the top side of the console 14. FIG. 1 shows the printing machine in a condition in which the printing cylinder 18 is separated from the reaction cylinder 12 and the inking roller 20 is separated from the printing cylinder 18. During printing operation the printing cylinder 18 is adjusted against the reaction cylinder 12, and the inking roller 20 is adjusted against the printing cylinder 18. To enable these adjusting and separating movements, a spindle drive having an actuator motor 28 and 30, respectively, and a drive spindle 32 and 34, respectively, is associated with each of the bearing blocks 24, 26. Each of the spindle drives is mounted on the console 14.

Figure 2:
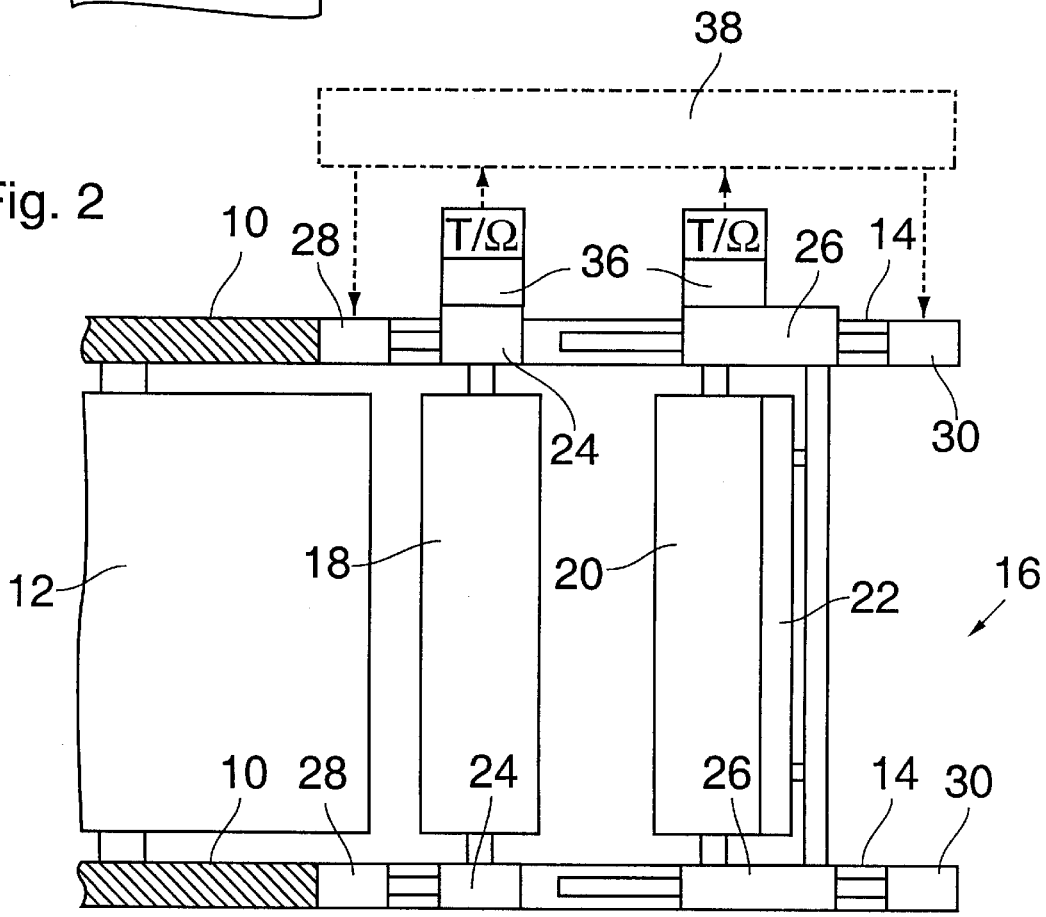
FIG. 2 is a schematic top plan view of the parts of the printing machine shown in FIG. 1 and of the collision detection system.

As is shown in FIG. 2, the inking unit 16 further comprises two separate drive motors 36 for the printing cylinder 18 and the inking roller 20. Each of these drive motors 36 is directly arranged on the shaft of the corresponding rotary body 18 or 20 on the drive side of the printing machine (top side in FIG. 2), so that each rotary body is driven for rotation by the associated drive motor 36 (single-drive). Synchronisation of the rotary bodies is controlled electronically in a known manner.

Each of the drive motors 36 has an integrated torque sensor T which supplies a torque signal to a control unit 38, as is symbolised by arrows in FIG. 2. The control unit 38 itself delivers control signals, in particular on- and off-signals to the actuator motors 28 and 30. In the drawing, only the control signals for the actuator motors on the drive side are symbolised by arrows. It will be understood however that corresponding control signals are also supplied to the actuator motors on the opposite side of the machine frame.

When, for example, the printing cylinder 18 is displaced transversely to its rotational axis by means of the actuator motors 28, collisions are monitored during this adjustment operation as follows. Before the adjustment operation begins, the printing cylinder 18 is driven for slow rotation by the drive motor 36. The torque generated by the drive motor 36 under these conditions is monitored by means of the integrated torque sensor T and is continuously reported to the control unit 38. When the outer circumference of the printing cylinder 18 collides for example with the reaction cylinder 12 or the inking roller 20, the rotary movement is braked, and the detected driving torque is increased correspondingly. As soon as this driving torque exceeds an adjustable threshold value, the control unit 38 supplies an off-signal to the actuator motors 28 and 30, and the displacement is stopped before the collision can lead to damages.

During the adjusting movements of the inking roller 20 the collision detection is performed in the same way. If the printing cylinder 18 and the inking roller 20 are displaced simultaneously, the collision detection for both rotary bodies is also performed simultaneously by the control unit 38. In this case, the slow rotation of the printing cylinder 18 and the inking roller 20 occurs in the same direction, so that the rotation is braked and, correspondingly, a higher driving torque is generated, when the circumferential surfaces of the printing cylinder 18 and the inking roller come into engagement with one another.

The ink fountain 22 can be separated from the inking roller 20 in a known manner by means of an actuator which is not shown. During the adjustment operation the ink fountain is conveniently separated from the inking roller, so that the rotation of the inking roller is not braked by contact with the ink fountain.

In a modified embodiment the drive motors 36 have an integrated angle increment sensor Ω in place of the torque sensor T. In this case, the collision is detected on the basis of the decrease of the angular velocity when the printing cylinder and the inking roller, respectively, is braked due to a collision with the obstacle. In this embodiment it is not necessary that the rotary body is permanently driven during the adjustment operation. Since the printing cylinder and the inking roller are supported with low friction in roller bearings, it is sufficient to impart a rotation to the rotary body before the adjustment operation begins, so that the rotary body is coasting during the adjustment operation and the collision can be detected on the basis of an irregular decrease of the angular velocity.

What is claimed is:

1. Method for detecting collisions in a printing machine having at least one rotationally driveable rotary body including two rotary bodies which may collide with one another, and actuators for adjusting the rotary bodies in a direction normal to the axis of rotation, said method comprising the steps of:

causing the at least one rotary body to rotate during an adjusting movement, said step of causing including the step of causing both rotary bodies to rotate in the same direction during the adjusting movement, when the actuators for both rotary bodies are operated simultaneously, and monitoring at least one of rotational speed and driving torque for rotational movement of said at least one rotary body.

2. Apparatus for detecting collisions in a printing machine having at least one rotationally driveable rotary body and an actuator for adjusting the rotary body in a direction normal to an axis of rotation thereof, comprising:

at least one of a torque sensor and an angle increment sensor for detecting at least one of driving torque and rotary speed of the at least one rotary body, and a control unit for detecting a collision of the at least one rotary body with another component member on the basis of a signal of the at least one of the torque sensor and the angle increment sensor and for stopping the actuator thereupon.

3. Apparatus according to claim 2, wherein the at least one rotationally driveable rotary body includes a printing cylinder.

4. Apparatus according to claim 3, further comprising an associated drive motor for individually driving each rotary body.

5. Apparatus according to claim 2, wherein the at least one rotationally driveable rotary body includes an inking roller.

6. Apparatus according to claim 5, further comprising an associated drive motor for individually driving each rotary body.

7. Apparatus according to claim 2, further comprising an associated drive motor for individually driving each rotary body.

* * * * *